US009242841B1

(12) United States Patent
Appleby et al.

(10) Patent No.: US 9,242,841 B1
(45) Date of Patent: Jan. 26, 2016

(54) CONTAINER OPENING SYSTEM

(76) Inventors: Linda D. Appleby, Trinity, FL (US); Emma Louise Faasse, Succasunna, NJ (US)

( * ) Notice: Subject to any disclaimer, the term of this patent is extended or adjusted under 35 U.S.C. 154(b) by 0 days.

(21) Appl. No.: 13/465,663

(22) Filed: May 7, 2012

Related U.S. Application Data

(60) Provisional application No. 61/484,666, filed on May 10, 2011, provisional application No. 61/484,629, filed on May 10, 2011.

(51) Int. Cl.
*B67B 7/18* (2006.01)

(52) U.S. Cl.
CPC .. *B67B 7/18* (2013.01); *B67B 7/184* (2013.01)

(58) Field of Classification Search
CPC ..... B67B 7/18; B67B 7/186; B67B 7/184; B25B 13/48
USPC ..... 81/3.4, 3.41, 3.43
See application file for complete search history.

(56) References Cited

U.S. PATENT DOCUMENTS

| | | | | |
|---|---|---|---|---|
| 4,001,904 | A * | 1/1977 | Gill | 7/151 |
| 4,090,419 | A * | 5/1978 | Abraham | 81/3.4 |
| 4,662,250 | A * | 5/1987 | Kee | 81/3.25 |
| 4,766,781 | A * | 8/1988 | Grise et al. | 81/3.4 |
| 5,836,221 | A * | 11/1998 | Hystead | 81/3.25 |
| 6,179,138 | B1 * | 1/2001 | Puleston | 215/226 |
| 6,666,110 | B1 * | 12/2003 | Buettner | 81/3.4 |
| 7,168,337 | B2 * | 1/2007 | Carmo | 81/3.43 |
| 2005/0193867 | A1 * | 9/2005 | Haynes | 81/3.4 |

* cited by examiner

*Primary Examiner* — Monica Carter
*Assistant Examiner* — Melanie Alexander

(57) ABSTRACT

A main body portion has a major section and a minor section integrally molded of an elastomeric material. The major section has a central aperture with an interior surface in a frustoconical configuration. The minor section extends laterally from the major section.

1 Claim, 4 Drawing Sheets

FIG. 1
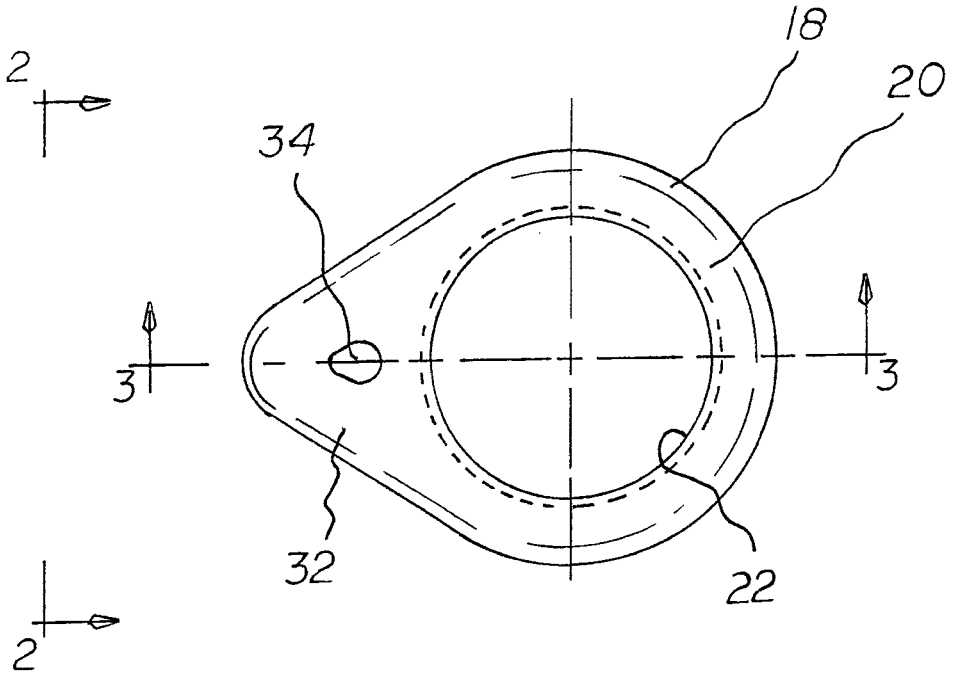
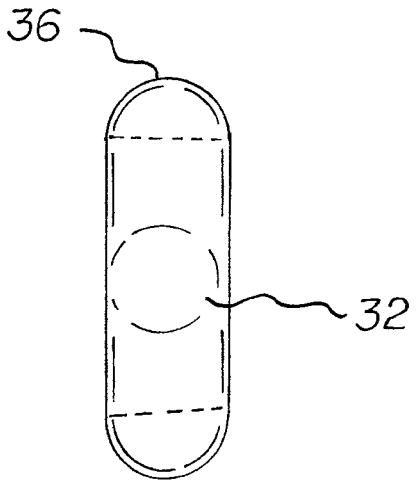
FIG. 2

FIG. 3
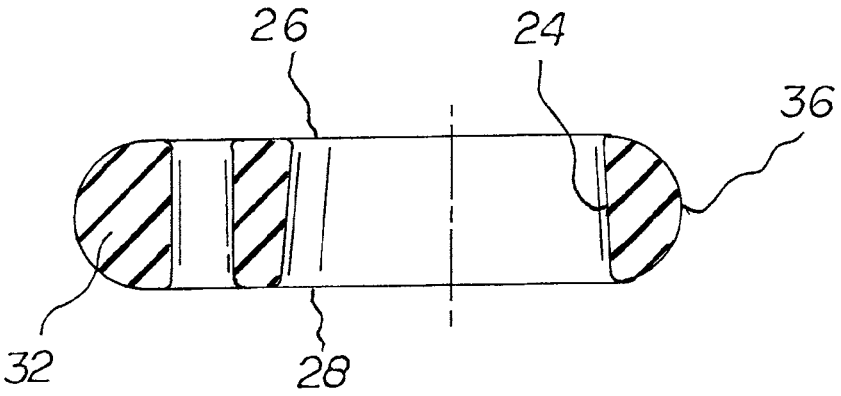
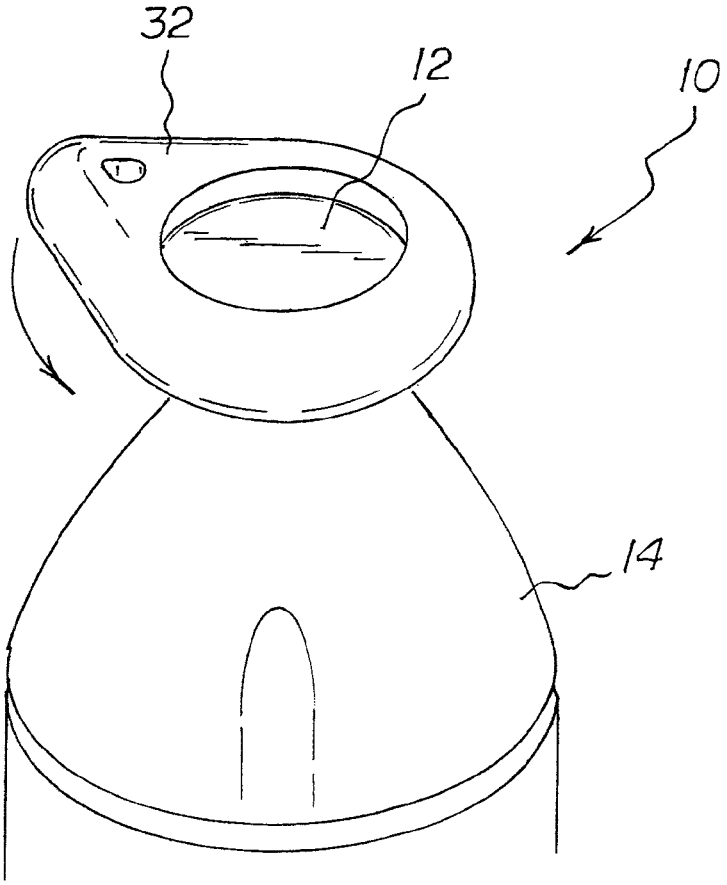
FIG. 4

FIG. 5
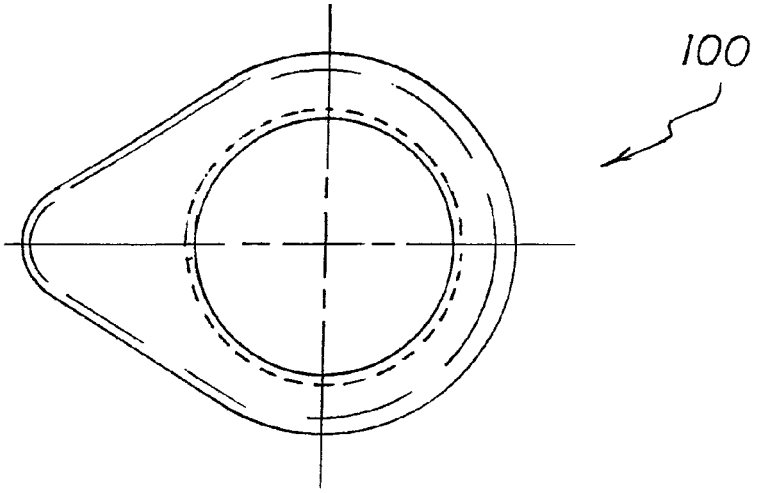
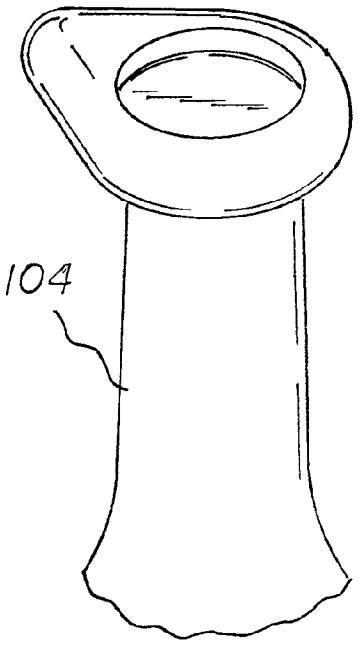
FIG. 6
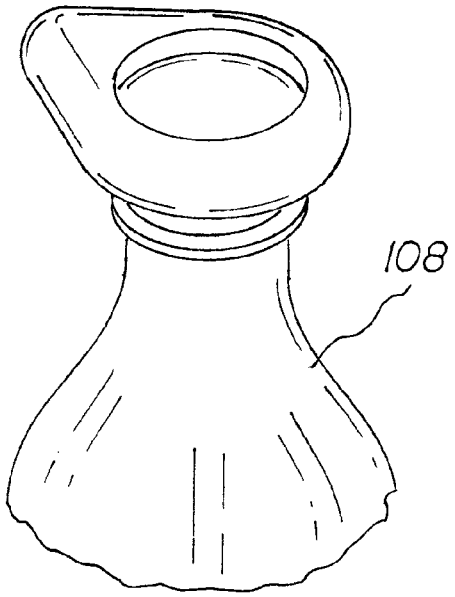
FIG. 7

CONTAINER OPENING SYSTEM

BACKGROUND OF THE INVENTION

1. Related Applications

The present non-provisional patent application is based upon Provisional Applications No. 61/484,629 filed May 10, 2011 and No. 61/484,666 filed May 10, 2011, the subject matter of which applications is incorporated herein by reference.

2. Field of the Invention

The present invention relates to a container opening system and more particularly pertains to grasping and twisting an interiorly threaded cap from a bottle with an externally threaded opening in a safe, efficient, convenient and economical manner.

DESCRIPTION OF THE PRIOR ART

The use of bottle cap opening systems of known designs and configurations is known in the prior art. More specifically, bottle cap opening systems of known designs and configurations previously devised and utilized for the purpose of removing threaded caps from bottles are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe container opening system that allows grasping and twisting an interiorly threaded cap from a bottle with an externally threaded opening in a safe, efficient, convenient and economical manner.

In this respect, the container opening system according to the present invention substantially departs from the conventional concepts and designs of the prior art, and in doing so provides an apparatus primarily developed for the purpose of grasping and twisting an interiorly threaded cap from a bottle with an externally threaded opening in a safe, efficient, convenient and economical manner.

Therefore, it can be appreciated that there exists a continuing need for a new and improved container opening system which can be used for grasping and twisting an interiorly threaded cap from a bottle with an externally threaded opening in a safe, efficient, convenient and economical manner. In this regard, the present invention substantially fulfills this need.

SUMMARY OF THE INVENTION

In view of the foregoing disadvantages inherent in the known types of bottle cap opening systems of known designs and configurations now present in the prior art, the present invention provides an improved container opening system. As such, the general purpose of the present invention, which will be described subsequently in greater detail, is to provide a new and improved container opening system and method which has all the advantages of the prior art and none of the disadvantages.

To attain this, the present invention essentially comprises a main body portion having a major section and a minor section integrally molded of an elastomeric material. The elastomeric material is chosen from the class of elastomeric materials including plastic and rubber, natural and synthetic, and blends thereof. The major section has a central aperture with an interior surface in a frusto-conical configuration. The minor section extends laterally from the major section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved container opening system which has all of the advantages of the prior art bottle cap opening systems of known designs and configurations and none of the disadvantages.

It is another object of the present invention to provide a new and improved container opening system which may be easily and efficiently manufactured and marketed.

It is further object of the present invention to provide a new and improved container opening system which is of durable and reliable constructions.

An even further object of the present invention is to provide a new and improved container opening system which is susceptible of a low cost of manufacture with regard to both materials and labor, and which accordingly is then susceptible of low prices of sale to the consuming public, thereby making such container opening system economically available to the buying public.

Even still another object of the present invention is to provide a container opening system for grasping and twisting an interiorly threaded cap from a bottle with an externally threaded opening in a safe, efficient, convenient and economical manner.

Lastly, it is an object of the present invention to provide a new and improved container opening system having a main body portion with a major section and a minor section integrally molded of an elastomeric material. The major section has a central aperture with an interior surface in a frusto-conical configuration. The minor section extends laterally from the major section.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a cap opening system constructed in accordance with the principles of the present invention.

FIG. 2 is an end elevational view taken along line 2-2 of FIG. 1.

FIG. 3 is an end elevational view taken along line 3-3 of FIG. 1.

FIG. 4 is a perspective illustration of the system shown in the prior Figured, the system being in use opening a water bottle.

FIG. 5 is a plan view of an alternate embodiment of the invention.

FIGS. 6 and 7 are perspective illustration of the system of FIG. 5, the system being in use opening a beer bottle and a soda bottle, respectively.

The same reference numerals refer to the same parts throughout the various Figures.

DESCRIPTION OF THE PREFERRED EMBODIMENT

Figure 8:
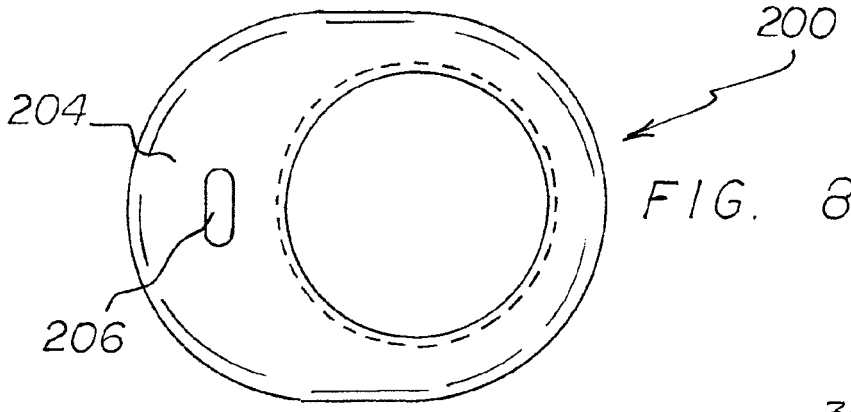
FIG. 8 is a plan view of another alternate embodiment of the invention, such embodiment having an oval shape rather than a tear drop shape of the prior Figures.

With reference now to the drawings, and in particular to FIG. 1 thereof, the preferred embodiment of the new and improved container opening system embodying the principles and concepts of the present invention and generally designated by the reference numeral 10 will be described.

The present invention, the container opening system 10 is comprised of a plurality of components. Such components in their broadest context include a main body portion with a major section and a single minor section integrally molded of an elastomeric material. Such components are individually configured and correlated with respect to each other so as to attain the desired objective.

The preferred embodiment is a bottle cap opening system 10 for grasping and twisting an interiorly threaded cap 12 from a bottle 14 with an externally threaded opening. The grasping and twisting are done in a safe, efficient, convenient and economical manner.

First provided is a main body portion 18. The main body portion has a major section 20 in a generally circular configuration. The major section has a central aperture 22 passing through the major section. The central aperture has an interior surface 24 in a frusto-conical configuration. The central aperture has an upper edge 26 with a diameter of 1.063 inches plus or minus 10 percent. The central aperture has a lower edge 28 with a diameter of 1.125 inches plus or minus 10 percent. The central aperture has a central axis with a height of 0.50 inches plus or minus 10 percent between the upper and lower edges. The interior surface of the central aperture forms an angle of between 3 and 4 degrees with respect to the central axis. The interior surface of the central aperture is adapted to contact a threaded bottle cap to facilitate gripping and twisting with respect to the bottle, preferably a water bottle.

The main body portion has a single minor section 32 in a generally triangular configuration extending laterally from the major section. The single minor section has a base between 75 and 95 percent of the diameter of the lower edge. The single minor section has a height between 80 and 120 percent of the diameter of the lower edge. A single minor aperture 34 passes through a central extent of the single minor section. The single minor aperture has a tear drop configuration with a minor axis parallel with the central axis. The single minor aperture is adapted to facilitate coupling the system to a recipient member. The main body portion includes the major section and the single minor section with an exterior edge 36 in a semi-circular configuration to facilitate handling. The main body portion includes the major section and the single minor section forming a tear drop configuration. The major section has a maximum exterior diameter remote from the single minor section of 1.562 inches plus or minus 10 percent.

The main body portion includes the major section and single minor section which are integrally molded of an elastomeric material. The elastomeric material is chosen from the class of elastomeric materials including plastic and rubber, natural and synthetic, and blends thereof. Preferred elastomeric materials are elastomeric materials chosen from the class of elastomeric materials including thermoplastic elastomer, monoprene and santoprene.

In an alternate embodiment of the system i00, the single minor section is imperforate. Note FIGS. 5, 6 and 7. In FIG. 6, the central aperture has a diameter for removing a bottle cap from a twist off cap beer bottle 104. In FIG. 7, the central aperture has a diameter for removing a bottle cap from a soft drink bottle 108. In another alternate embodiment of the system 200 is shown in FIG. 8. In this embodiment, the single minor section 204 is crescent shaped and the single minor section has an oval aperture 206.

Figure 9:
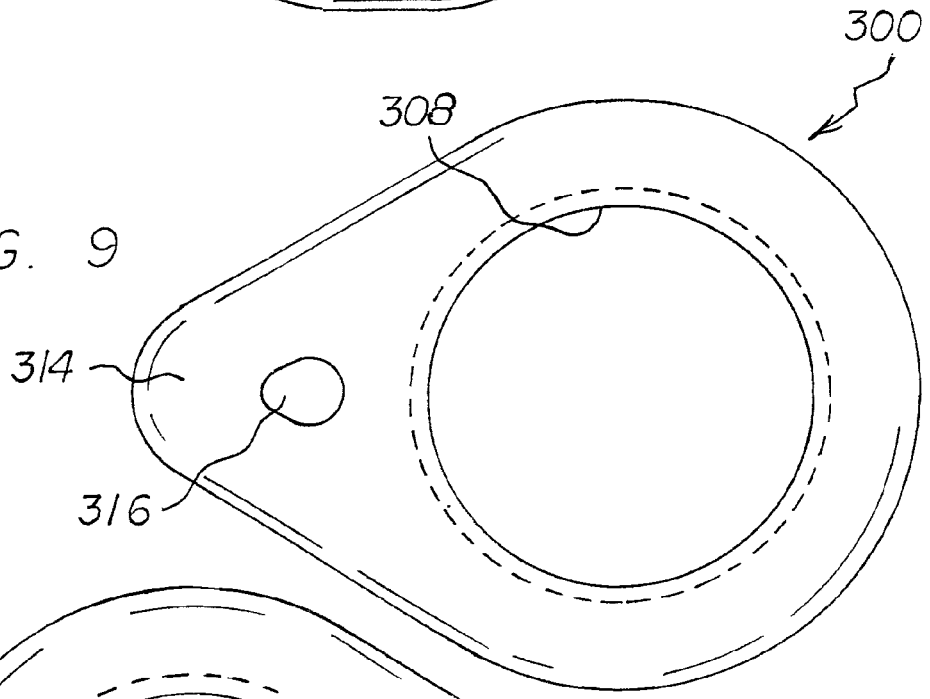
FIGS. 9 and 10 are plan views of final alternate embodiments, such embodiments being of a larger size for larger containers such as sports drink bottles.
Figure 10:
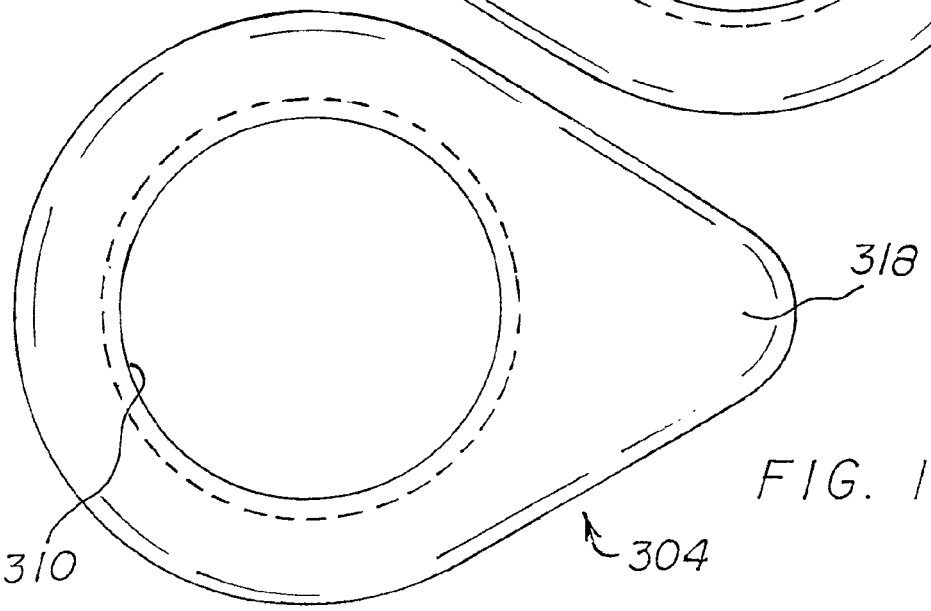

In a final embodiment of the system 300, 304 the central aperture 308, 310 has a diameter of between 1.6 inches and 1.7 inches for removing a bottle cap from a larger sports bottle. As shown in FIG. 9, the single minor section 314 includes a single minor aperture 316. As shown in FIG. 10, the single minor section 318 is imperforate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bottle cap opening system (10) for grasping and twisting an interiorly threaded cap (12) from a bottle (14) with an externally threaded opening, the grasping and twisting being done in a safe, efficient, convenient and economical manner, the system consisting of, in combination:

a main body portion (18) with a major section (20) in a generally circular configuration, the major section having a central aperture (22) passing through the major section, the central aperture having an interior surface (24) in a frusto-conical configuration, the entire interior surface being smooth and continuous both circumferentially and axially, the central aperture having an upper edge (26) with a diameter of 1.063 inches plus or minus 10 percent, the central aperture having a lower edge (28) with a diameter of 1.125 inches plus or minus 10 percent, the central aperture having a central axis with a height of 0.50 inches plus or minus 10 percent between the upper and lower edges, the interior surface of the central aperture forming an angle of between 3 and 4 degrees with respect to the central axis, the interior surface of the central aperture adapted to contact a threaded bottle cap to facilitate gripping and twisting with respect to the bottle;

the main body portion having a single minor section (32) in a generally triangular configuration extending laterally from the major section during use, the minor section having a base between 75 and 95 percent of the diameter of the lower edge, the minor section having a height between 80 and 120 percent of the radius of the lower edge of the central aperture, a single minor aperture (34) passing through a central extent of the minor section, the minor aperture having a tear drop configuration with a minor axis parallel with the central axis, the minor aperture adapted to facilitate coupling the system to a recipient member, the main body portion including the major section and the minor section having an exterior edge (36) with a semi-circular configuration to form an exterior edge, to facilitate handling, the main body portion including the major section and the minor section forming a tear drop configuration, the major section having a maximum exterior diameter remote from the minor section of 1.562 inches plus or minus 10 percent;

the main body portion including the major section and minor section being integrally molded of an elastomeric material chosen from the class of elastomeric materials including thermoplastic elastomer, monoprene and santoprene.

* * * * *